US009863353B2

(12) United States Patent
Makled et al.

(10) Patent No.: US 9,863,353 B2
(45) Date of Patent: Jan. 9, 2018

(54) METHODS AND SYSTEMS FOR ESTIMATING AN AIR-FUEL RATIO WITH A VARIABLE VOLTAGE OXYGEN SENSOR

(71) Applicant: Ford Global Technologies, LLC, Dearborn, MI (US)

(72) Inventors: Daniel A. Makled, Dearborn, MI (US); Gopichandra Surnilla, West Bloomfield, MI (US); Richard E. Soltis, Saline, MI (US); Kenneth John Behr, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/461,942

(22) Filed: Mar. 17, 2017

(65) Prior Publication Data

US 2017/0191436 A1 Jul. 6, 2017

Related U.S. Application Data

(63) Continuation of application No. 14/626,542, filed on Feb. 19, 2015, now Pat. No. 9,611,799.

(51) Int. Cl.
*F02D 41/14* (2006.01)
*F02D 41/24* (2006.01)

(52) U.S. Cl.
CPC ..... *F02D 41/1454* (2013.01); *F02D 41/1456* (2013.01); *F02D 41/2474* (2013.01)

(58) Field of Classification Search
CPC ..... F02D 41/1454; F02D 41/1456; F02D 41/0295; F02D 41/2474; F02D 41/26; F02D 41/1458; F02D 41/1465; F02D 41/248; F02D 41/2454
See application file for complete search history.

(56) References Cited

U.S. PATENT DOCUMENTS

| | | | |
|---|---|---|---|
| 6,016,796 | A | 1/2000 | Dalton |
| 8,495,996 | B2 | 7/2013 | Soltis et al. |
| 8,522,760 | B2 | 9/2013 | Soltis |
| 8,603,310 | B2 | 12/2013 | Ishida et al. |
| 8,731,806 | B2 | 5/2014 | Soltis et al. |
| 8,857,155 | B2 | 10/2014 | Surnilla et al. |
| 9,017,217 | B2 | 4/2015 | Norman et al. |
| 9,322,367 | B2 | 4/2016 | Vigild et al. |
| 9,376,968 | B2 | 6/2016 | Surnilla et al. |
| 9,404,432 | B2 | 8/2016 | Surnilla et al. |
| 9,528,448 | B2 | 12/2016 | Makled et al. |
| 9,628,011 | B2 | 4/2017 | DeMarco et al. |
| 2010/0236532 | A1 | 9/2010 | Xiao et al. |
| 2011/0132340 | A1 | 6/2011 | Soltis |
| 2013/0333677 | A1 | 12/2013 | Surnilla et al. |

(Continued)

*Primary Examiner* — Hung Q Nguyen
*Assistant Examiner* — Xiao Mo
(74) *Attorney, Agent, or Firm* — Julia Voutyras; McCoy Russell LLP

(57) ABSTRACT

Methods and systems are provided for estimating an exhaust air/fuel ratio based on outputs from an exhaust oxygen sensor. In one example, a method may include adjusting engine operation based on an air-fuel ratio estimated based on an output of the exhaust oxygen sensor and a learned correction factor. For example, the oxygen sensor may operate in a variable voltage mode in which a reference voltage of the oxygen sensor may be adjusted between a lower first voltage and a higher second voltage, and the learned correction factor is based on the second voltage.

20 Claims, 7 Drawing Sheets

(56) References Cited

U.S. PATENT DOCUMENTS

| | | | |
|---|---|---|---|
| 2014/0156172 | A1 | 6/2014 | Surnilla et al. |
| 2014/0202437 | A1 | 7/2014 | Surnilla et al. |
| 2014/0238368 | A1 | 8/2014 | Jammoussi et al. |
| 2014/0345584 | A1 | 11/2014 | Jammoussi et al. |
| 2015/0101328 | A1 | 4/2015 | Surnilla et al. |
| 2015/0121864 | A1 | 5/2015 | Surnilla et al. |
| 2015/0192084 | A1 | 7/2015 | Surnilla et al. |
| 2015/0192085 | A1 | 7/2015 | Surnilla et al. |
| 2015/0337745 | A1 | 11/2015 | MacNeille et al. |
| 2016/0109422 | A1 | 4/2016 | Makled et al. |
| 2016/0245190 | A1 | 8/2016 | Makled et al. |
| 2016/0245198 | A1 | 8/2016 | Surnilla et al. |

METHODS AND SYSTEMS FOR ESTIMATING AN AIR-FUEL RATIO WITH A VARIABLE VOLTAGE OXYGEN SENSOR

CROSS-REFERENCE TO RELATED APPLICATION

The present application is a continuation of U.S. patent application Ser. No. 14/626,542 entitled "METHODS AND SYSTEMS FOR ESTIMATING AN AIR-FUEL RATIO WITH A VARIABLE VOLTAGE OXYGEN SENSOR," filed on Feb. 19, 2015, the entire contents of which are incorporated herein by reference for all purposes.

FIELD

The present description relates generally to methods and systems for operating a variable voltage exhaust gas sensor of an internal combustion engine.

BACKGROUND/SUMMARY

An exhaust gas sensor (e.g., exhaust oxygen sensor) may be positioned in an exhaust system of a vehicle and operated to provide indications of various exhaust gas constituents. In one example, the exhaust gas sensor may be used to detect an air-fuel ratio of exhaust gas exhausted from an internal combustion engine of the vehicle. The exhaust gas sensor readings may then be used to control operation of the internal combustion engine to propel the vehicle. In another example, outputs of the exhaust gas sensor may be used to estimate a water content in the exhaust gas. Water content estimated using the exhaust gas oxygen sensor may be used to infer an ambient humidity during engine operation. Further still, the water content may be used to infer an alcohol content of a fuel burned in the engine. Under select conditions, the exhaust gas sensor may be operated as a variable voltage (VVs) oxygen sensor in order to more accurately determine exhaust water content. When operating in the VVs mode, a reference voltage of the exhaust gas sensor is increased from a lower, base voltage (e.g., approximately 450 mv) to a higher, target voltage (e.g., in a range of 900-1100 mV). In some examples, the higher, target voltage may be a voltage at which water molecules are partially or fully dissociated at the oxygen sensor while the base voltage is a voltage at which water molecules are not dissociated at the sensor.

However, the inventors herein have recognized potential issues with operating the exhaust gas sensor in the VVs mode. As one example, air-fuel estimates with the exhaust gas sensor may be invalid when the reference voltage is increased above the base voltage since the oxygen sensor is no longer stoichiometric. For example, at higher reference voltages, the sensor dissociates water vapor and carbon dioxide which contribute to the oxygen concentration represented in the pumping current output by the exhaust gas sensor. Since water vapor and carbon dioxide change with ambient humidity and ethanol concentration in the fuel, and these parameters are unknown, traditional pumping current to air-fuel ratio transfer functions are not accurate at elevated reference voltages. As a result, the vehicle may have to operate in open loop fuel control which may negatively impact emissions, fuel economy, and drivability.

In one example, the issues described above may be addressed by a method for: during operation of an exhaust oxygen sensor in a variable voltage mode where a reference voltage of the oxygen sensor is adjusted from a lower, first voltage to a higher, second voltage, adjusting engine operation based on an air-fuel ratio estimated based on an output of the exhaust oxygen sensor and a learned correction factor based on the second voltage. In other words, a learned correction factor may be used to adjust air/fuel estimates based on outputs of an oxygen sensor when the oxygen sensor operates in a variable voltage mode. As a result, the accuracy of air-fuel ratio estimates while the exhaust oxygen sensor is operating at the higher, second voltage may be increased, thereby increasing the accuracy of engine control based on the estimated air-fuel ratio.

As one example, an exhaust oxygen sensor may operate in a variable voltage mode whereby a reference voltage applied to the oxygen sensor may be adjusted between a lower first voltage where water vapor and carbon dioxide are not dissociated and a higher second voltage where water and/or carbon dioxide are dissociated. A correction factor may be learned based on a difference between a pumping current output by the oxygen sensor when operating at the higher second voltage, and a reference pumping current. The reference pumping current may be based on a known transfer function that relates pumping currents to air/fuel ratios specifically at the second reference voltage. The correction factor may be used to adjust air/fuel ratio estimates when the oxygen sensor operates in a variable voltage mode. In this way, when the exhaust oxygen sensor is operating in the variable voltage mode to determine an additional operating parameter of the engine, air/fuel ratio may also be estimated based on the output of the exhaust oxygen sensor without needing to go into open loop air/fuel control.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
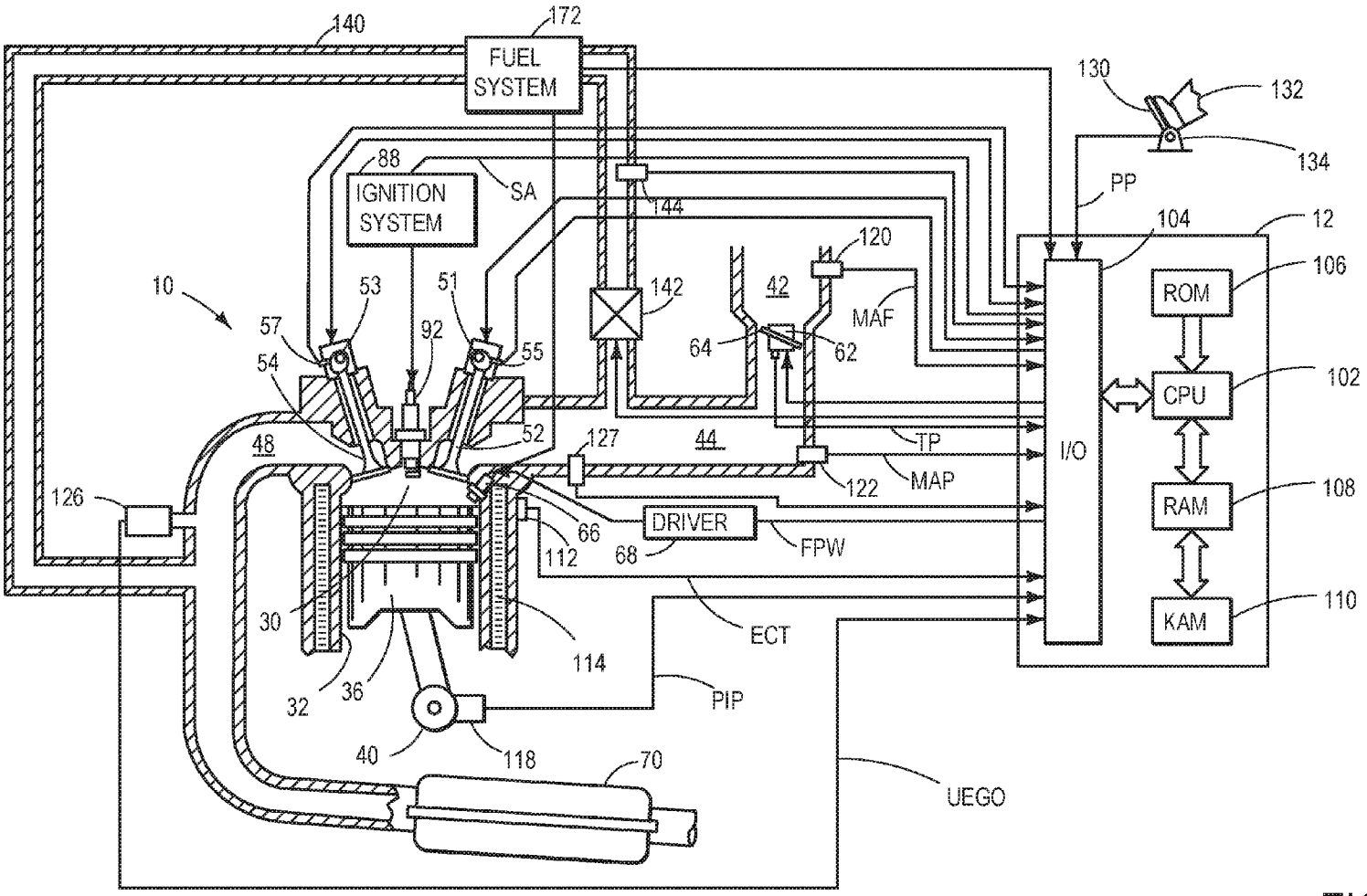
FIG. 1 shows a schematic diagram of an engine including an exhaust gas oxygen sensor.
Figure 2:
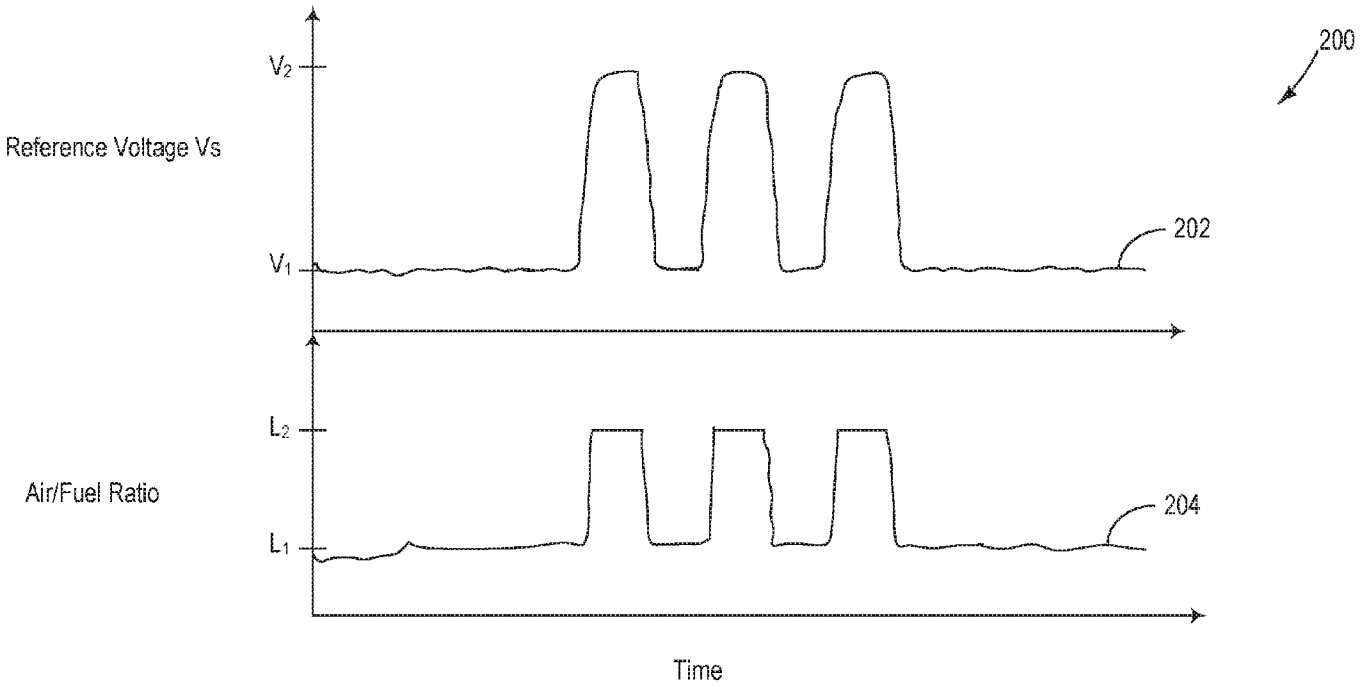
FIG. 2 shows a graph depicting how estimates of the air/fuel ratio may be affected by changes in the reference voltage of an exhaust oxygen sensor.
Figure 3:
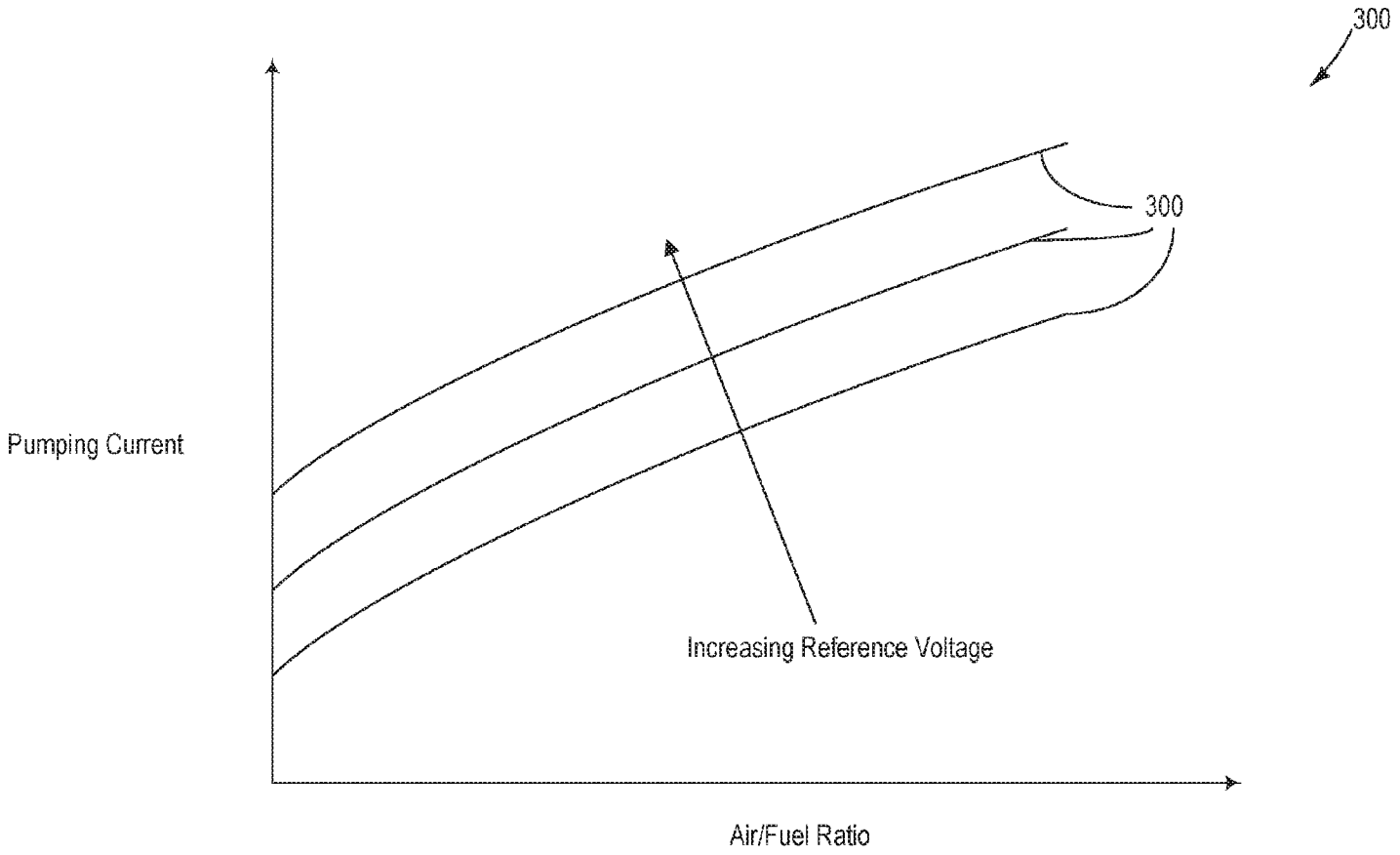
FIG. 3 shows a graph depicting the impact of reference voltage on outputs of an exhaust oxygen sensor.
Figure 5:
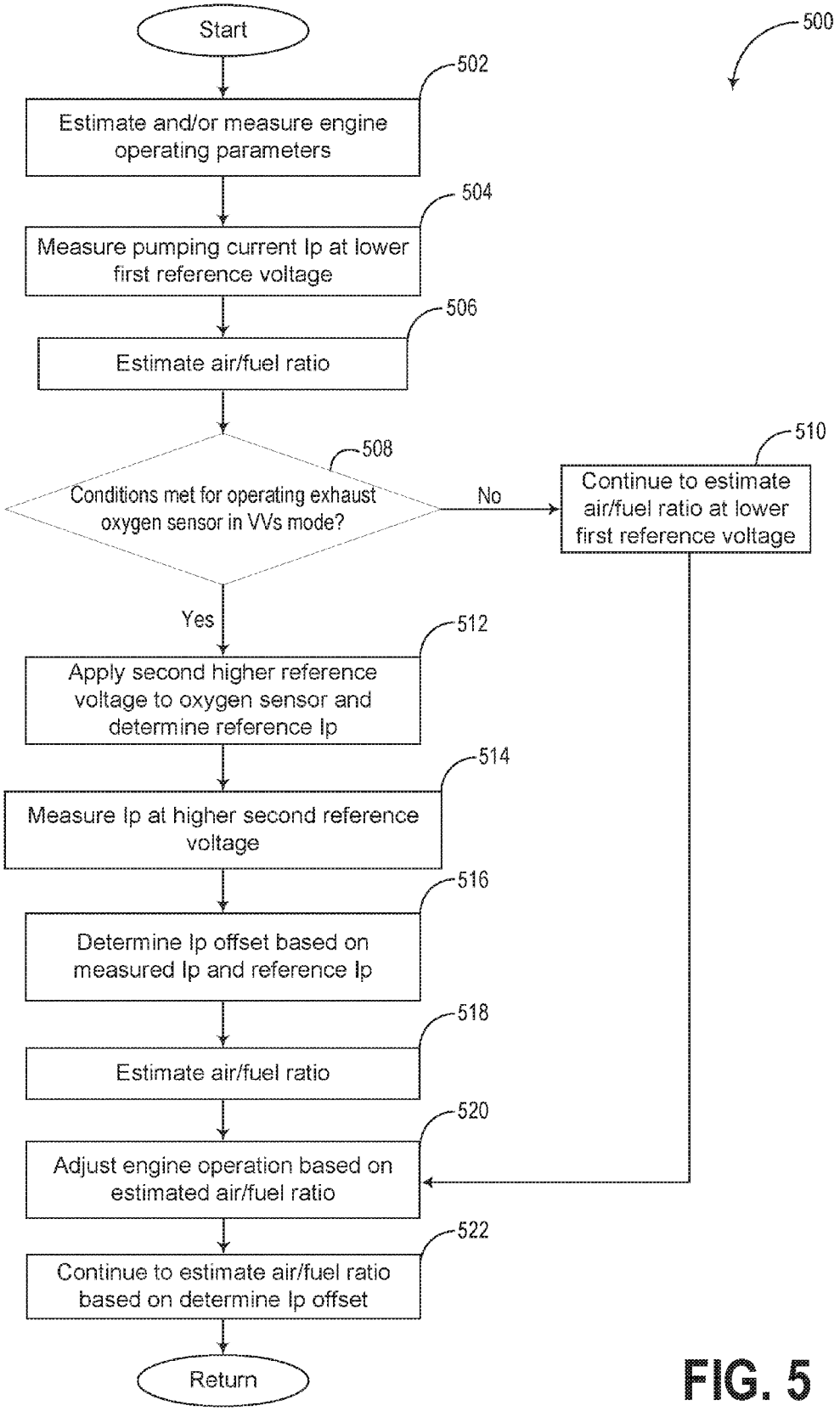
FIG. 5 shows a flow chart of a method for estimating an exhaust air/fuel ratio during variable voltage operation of an exhaust oxygen sensor.
Figure 6:
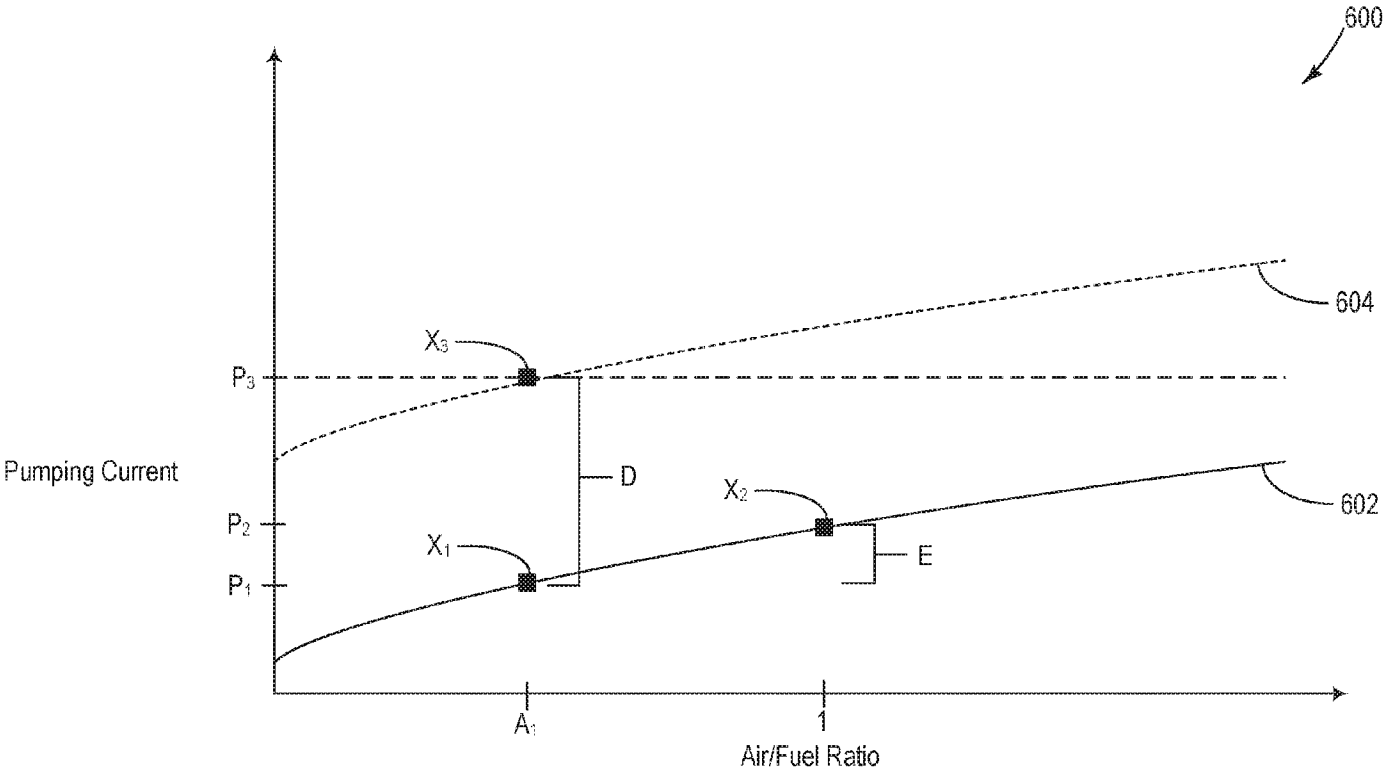
FIG. 6 shows a graph depicting the method described in FIG. 5.
Figure 7:
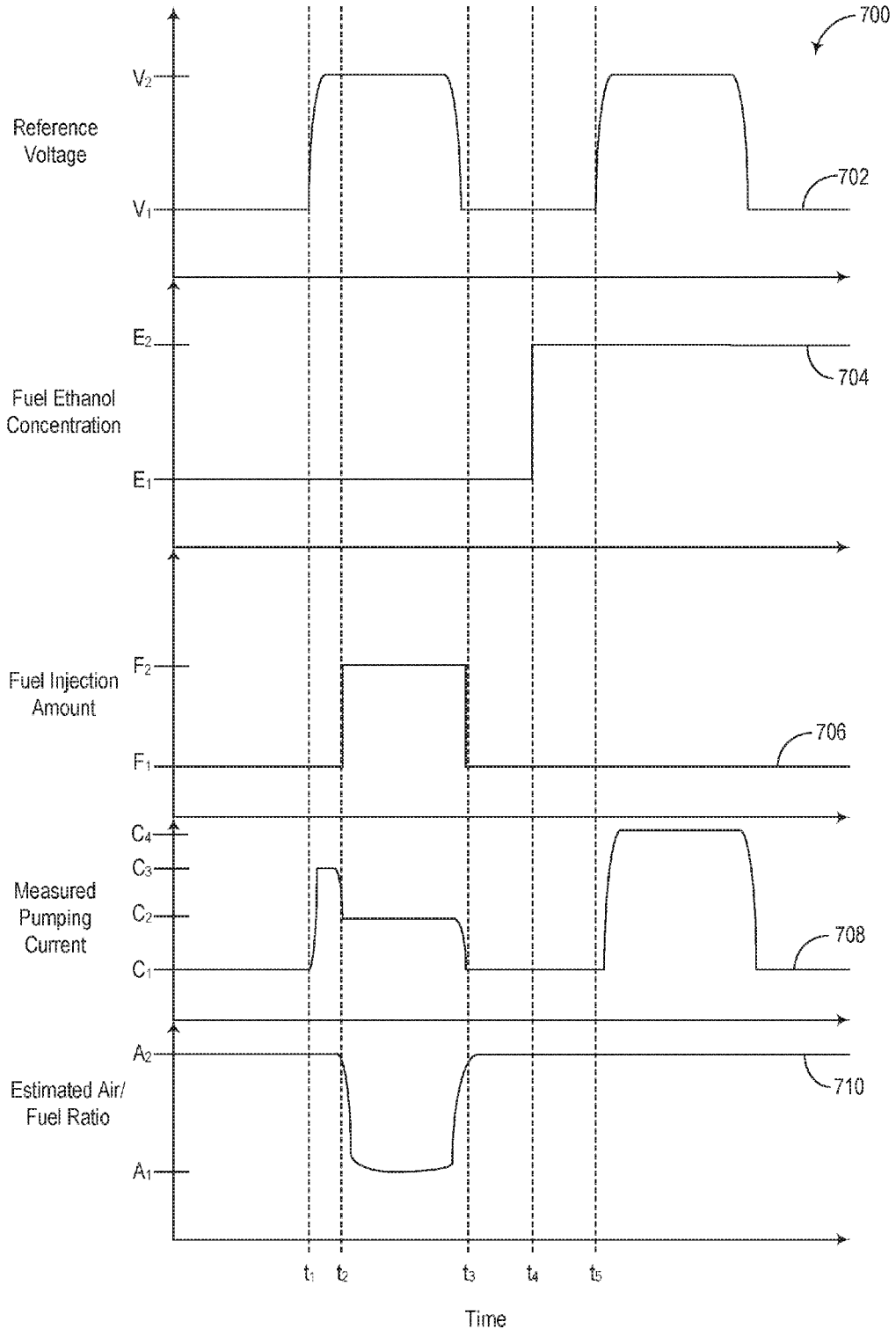
FIG. 7 shows a graph depicting changes in air/fuel estimates under varying engine operating conditions using an exhaust oxygen sensor.

The following description relates to systems and methods for estimating an air/fuel ratio in exhaust gas. As shown in FIG. 1, an engine may include an exhaust oxygen sensor located in an exhaust passage of the engine. The oxygen sensor may be a variable voltage oxygen sensor and as such a reference voltage of the oxygen sensor may be adjusted between a lower, first voltage where water vapor and carbon dioxide are not dissociated, and a higher, second voltage where water and/or carbon dioxide are dissociated. Outputs of the oxygen sensor may be in the form of pumping currents which may be used to determine an air/fuel ratio of the exhaust gas. Specifically, changes in the pumping current from a reference point taken when the oxygen sensor was operating during a non-fueling conditions such as during a deceleration fuel shut-off (DFSO) event may be used to infer an air/fuel ratio. However, as seen in FIG. 2 when operating at the higher second voltage, outputs of the oxygen sensor may be corrupted, and as such the accuracy of estimates of the air/fuel ratio may be reduced. Under conditions of constant humidity and fuel ethanol concentration, transfer functions may be established between the pumping current and air/fuel ratio for any given reference voltage, as shown in FIG. 3. Thus, as long as ambient humidity and fuel ethanol concentration remain constant, changes in the reference voltage may be accounted for by selecting a transfer function associated with the new reference voltage. However if the ambient humidity and fuel ethanol concentration change, the accuracy of air/fuel ratio estimates using the transfer functions becomes reduced. Specifically, the pumping current and therefore estimates of the air/fuel ratio may be affected by changes in the fuel ethanol concentration, as evidenced in FIG. 4. FIG. 5 shows a method for increasing the accuracy of air/fuel ratio estimates during operation of the oxygen sensor at the higher second reference voltage. Specifically, an offset may be established based on a comparison of the pumping current measured at the second reference voltage to a reference pumping current, as seen in FIG. 6. The learned offset may then be used to adjust the air/fuel ratio. As such, errors in the air/fuel estimation when the oxygen sensor is operating in a variable voltage mode may be reduced, as seen in FIG. 7.

Referring now to FIG. 1, a schematic diagram showing one cylinder of a multi-cylinder engine 10, which may be included in a propulsion system of an automobile, is illustrated. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal PP. A combustion chamber (i.e., cylinder) 30 of the engine 10 may include combustion chamber walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and exhaust passage 48 can selectively communicate with the combustion chamber 30 via respective intake valve 52 and exhaust valve 54. In some embodiments, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by a controller 12 to vary valve operation. The position of the intake valve 52 and exhaust valve 54 may be determined by position sensors 55 and 57, respectively. In alternative embodiments, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

In some embodiments, each cylinder of the engine 10 may be configured with one or more fuel injectors for providing fuel thereto. As a non-limiting example, the cylinder 30 is shown including one fuel injector 66. The fuel injector 66 is shown coupled directly to the cylinder 30 for injecting fuel directly therein in proportion to the pulse width of signal FPW received from the controller 12 via an electronic driver 68. In this manner, the fuel injector 66 provides what is known as direct injection (hereafter also referred to as "DI") of fuel into the combustion cylinder 30.

It will be appreciated that in an alternate embodiment, the injector 66 may be a port injector providing fuel into the intake port upstream of the cylinder 30. It will also be appreciated that the cylinder 30 may receive fuel from a plurality of injectors, such as a plurality of port injectors, a plurality of direct injectors, or a combination thereof.

A fuel tank in a fuel system 172 may hold fuels with different fuel qualities, such as different fuel compositions. These differences may include different alcohol content, different octane, different heats of vaporization, different fuel blends, and/or combinations thereof etc. The engine may use an alcohol containing fuel blend such as E85 (which is approximately 85% ethanol and 15% gasoline) or M85 (which is approximately 85% methanol and 15% gasoline). Alternatively, the engine may operate with other ratios of gasoline and ethanol stored in the tank, including 100% gasoline and 100% ethanol, and variable ratios therebetween, depending on the alcohol content of fuel supplied by the operator to the tank. Moreover, fuel characteristics of the fuel tank may vary frequently. In one example, a driver may refill the fuel tank with E85 one day, and E10 the next, and E50 the next. As such, based on the level and composition of the fuel remaining in the tank at the time of refilling, the fuel tank composition may change dynamically.

The day to day variations in tank refilling can thus result in frequently varying fuel composition of the fuel in the fuel system 172, thereby affecting the fuel composition and/or fuel quality delivered by the injector 66. The different fuel compositions injected by the injector 66 may herein be referred to as a fuel type. In one example, the different fuel compositions may be qualitatively described by their research octane number (RON) rating, alcohol percentage, ethanol percentage, etc.

It will be appreciated that while in one embodiment, the engine may be operated by injecting the variable fuel blend via a direct injector, in alternate embodiments, the engine may be operated by using two injectors and varying a relative amount of injection from each injector. It will be further appreciated that when operating the engine with a boost from a boosting device such as a turbocharger or supercharger (not shown), the boosting limit may be increased as an alcohol content of the variable fuel blend is increased.

Continuing with FIG. 1, the intake passage 42 may include a throttle 62 having a throttle plate 64. In this particular example, the position of the throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal TP. The intake passage 42 may include a mass air flow sensor 120 and a manifold air pressure sensor 122 for providing respective signals MAF and MAP to controller 12.

An ignition system 88 can provide an ignition spark to the combustion chamber 30 via a spark plug 92 in response to a spark advance signal SA from the controller 12, under select operating modes. Though spark ignition components are shown, in some embodiments, the combustion chamber 30 or one or more other combustion chambers of the engine 10 may be operated in a compression ignition mode, with or without an ignition spark.

A UEGO (universal or wide-range exhaust gas oxygen) oxygen sensor 126 is shown coupled to the exhaust passage 48 upstream of an emission control device 70. The oxygen sensor 126 may also be a variable voltage (VVs) oxygen sensor. A reference voltage of the VVs oxygen sensor may be adjustable between a lower base voltage (e.g., first voltage) where water is not dissociated and a higher target voltage (e.g., second voltage) where water is dissociated. The outputs of the oxygen sensor at the two reference voltages may then be used to determine water content of the exhaust air of the engine. Additionally, as will be explained in greater detail below, the oxygen sensor 126 may be used to provide an indication of the exhaust gas air/fuel ratio during both operation at the lower base voltage and also at the higher target voltage. The emission control device 70 is shown arranged along the exhaust passage 48 downstream of the VVs oxygen sensor 126. The device 70 may be a three way catalyst (TWC), $NO_x$ trap, various other emission control devices, or combinations thereof. In some embodiments, during operation of engine 10, emission control device 70 may be periodically reset by operating at least one cylinder of the engine within a particular air/fuel ratio.

As shown in the example of FIG. 1, the system further includes an intake air sensor 127 coupled to the intake passage 44. The sensor 127 may be a VVs oxygen sensor, but it may also be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor.

Further, in the disclosed embodiments, an exhaust gas recirculation (EGR) system may route a desired portion of exhaust gas from the exhaust passage 48 to the intake passage 44 via an EGR passage 140. The amount of EGR provided to the intake passage 44 may be varied by the controller 12 via an EGR valve 142. Further, an EGR sensor 144 may be arranged within the EGR passage 140 and may provide an indication of one or more of pressure, temperature, and concentration of the exhaust gas. Under some conditions, the EGR system may be used to regulate the temperature of the air and fuel mixture within the combustion chamber, thus providing a method of controlling the timing of ignition during some combustion modes. Further, during some conditions, a portion of combustion gases may be retained or trapped in the combustion chamber by controlling exhaust valve timing, such as by controlling a variable valve timing mechanism.

The controller 12 is shown in FIG. 1 as a microcomputer, including a microprocessor unit 102, input/output ports 104, an electronic storage medium for executable programs and calibration values shown as read only memory chip 106 in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; a profile ignition pickup signal (PIP) from a Hall effect sensor 118 (or other type) coupled to the crankshaft 40; throttle position (TP) from a throttle position sensor; and absolute manifold pressure signal, MAP, from the sensor 122. Engine speed signal, RPM, may be generated by the controller 12 from signal PIP.

The storage medium read-only memory 106 can be programmed with computer readable data representing instructions executable by the processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

Turning to FIG. 2, a graph 200 depicts how the exhaust air/fuel ratio estimated with an exhaust oxygen sensor (e.g., oxygen sensor 126) may be corrupted by changes in a reference of voltage of the exhaust oxygen sensor. Plot 202 shows changes in the reference voltage applied to the oxygen sensor, and plot 204 shows the air/fuel estimated based on an output of the oxygen sensor in the form of pumping current, as explained above. As described with reference to FIG. 1, outputs from a variable voltage (VVs) exhaust gas oxygen sensor (e.g., oxygen sensor 126) may be used to estimate an air/fuel ratio in the exhaust gas. Specifically, the outputs of the oxygen sensor may be in the form of a pumping current (Ip) generated by an applied reference voltage. The pumping current may change in response to changes in the amount of fuel injected to the engine cylinders (e.g., cylinder 30) and thus may be used as an indication of the air/fuel ratio. The air/fuel ratio may be estimated based on a change in the pumping current from a baseline value when fuel is not being supplied to the engine cylinders. The baseline value may be estimated during non-fueling conditions such as during a deceleration fuel shut-off (DFSO) event. Additionally, the oxygen sensor may be used to estimate an amount of water in the exhaust gas which may be used to estimate various engine operating parameters such as ambient humidity, fuel ethanol content and, if the engine is a dual-fuel engine, a secondary fluid injection amount. To give an estimate of the water content, the reference voltage oxygen sensor may be adjusted between a lower base voltage, $V_1$ as depicted in plot 202, where water is not dissociated (e.g., approximately 450 mV) and a higher target voltage $V_2$, where water is dissociated (e.g., approximately 1100 mV). The water content may be estimated by comparing the difference in pumping current output at the two different reference voltages. Thus, as seen in plot 202, the reference voltage may be modulated between $V_1$ and $V_2$ to measure a water content in the exhaust gas.

However, during operation of the oxygen sensor at the higher target voltage, the estimate of the air/fuel ratio may be corrupted. Specifically, at the higher reference voltage $V_2$, the oxygen sensor dissociates water vapor and carbon dioxide, which may contribute to the oxygen concentration represented in the Ip signal. Thus, as a result of increases in the reference voltage, the Ip signal may increase due to increases in the oxygen concentration as a result of water vapor and carbon dioxide dissociating. As a result, the air/fuel ratio may be overestimated. As can be seen at plot 204, when the reference voltage is increased from $V_1$ to $V_2$ the estimate of the air/fuel ratio increases from a lower first level $L_1$ to a higher second value $L_2$, even though the actual air/fuel ratio may remain at relatively the same first level $L_1$. Air/fuel ratio estimates may therefore have reduced accuracy when the oxygen sensor is operating at a reference voltage high enough to dissociate water and/or carbon dioxide. Thus, traditional methods of estimating the air/fuel ratio using a variable voltage exhaust gas sensor may be limited to estimating the air/fuel ratio only when the oxygen sensor is operating at its lower base voltage or a voltage low enough such that water vapor and carbon dioxide are not dissociated.

To increase the accuracy of the air/fuel estimations when the oxygen sensor is operating at a high enough reference voltage to dissociate water vapor and carbon dioxide, a correction factor may be used to compensate for the additional oxygen contributed by the dissociated water vapor and carbon dioxide.

Turning to FIG. 3, a graph 300 shows how the reference voltage applied to the exhaust oxygen sensor may impact the pumping current output by the oxygen sensor. The controller (e.g. controller 12) may control the reference voltage applied to the oxygen sensor and as such, the reference voltage applied to the oxygen sensor may be known at all times. Graph 300 shows a plurality of transfer function curves 300, where each transfer function curve 300 shows how the pumping current and air/fuel ratio may be related at a given reference voltage. Specifically, the air/fuel ratio may increase as the pumping current increases for a given reference voltage. As explained above, the increase in pumping current may be related to an increase in oxygen concentration, which may imply an increase in the amount of ambient air relative to fuel. The relationship between pumping current and air/fuel ratio may be learned for any given reference voltage. Thus, for a given reference voltage, a known transfer function relating pumping current and air/fuel ratio may be established. However, changes in reference voltage also result in changes in the pumping current. For a given air/fuel ratio, as the reference voltage increases, so does the pumping current. As explained above the increase in pumping current may be due to contributions from water and carbon dioxide molecules as they become dissociated with increasing reference voltages. The shape of the transfer functions may remain constant at all reference voltages, however the transfer functions may be shifted. In other words, for all reference voltages, changes in the air/fuel ratio by a given amount may be related to the same or similar change in pumping current. Thus, all transfer functions shown in graph 300 may be superimposed on one another by simply shifting them up or down on the pumping current axis of the graph 300. In this way, the added oxygen contributions from dissociated water vapor and carbon dioxide may be accounted for. Thus, by learning how the pumping current may be impacted by dissociated water and carbon dioxide molecules the air/fuel estimates may be corrected based on the reference voltage applied to the oxygen sensor. In other words, since the reference voltage applied to the oxygen sensor is known, a transfer function describing the relationship between pumping current and air/fuel ratio at the known reference voltage may be selected from a plurality of transfer functions representing different reference voltages (e.g., each transfer function may be stored within a memory of the controller as a function of oxygen sensor reference voltage). In doing so, the accuracy of the air/fuel ratio may be increased at reference voltages high enough to dissociate water and carbon dioxide.

It is important to note that the ambient humidity and ethanol concentration of the fuel are assumed to remain constant in graph 300 for all transfer functions depicted. Specifically, the ethanol content may be assumed to be 0% and the ambient humidity may be assumed to be 0% for each of the pumping current to air/fuel ratio transfer functions. However, the ambient humidity and fuel ethanol content may be different than these baseline 0% values. For example, the ambient humidity may change depending on the driving environment and ethanol concentration of the fuel may change after re-fueling. Changes in humidity and ethanol content of the fuel may affect the pumping current of the oxygen sensor when operating at a reference voltage high enough to dissociate water vapor and/or carbon dioxide.

Figure 4:
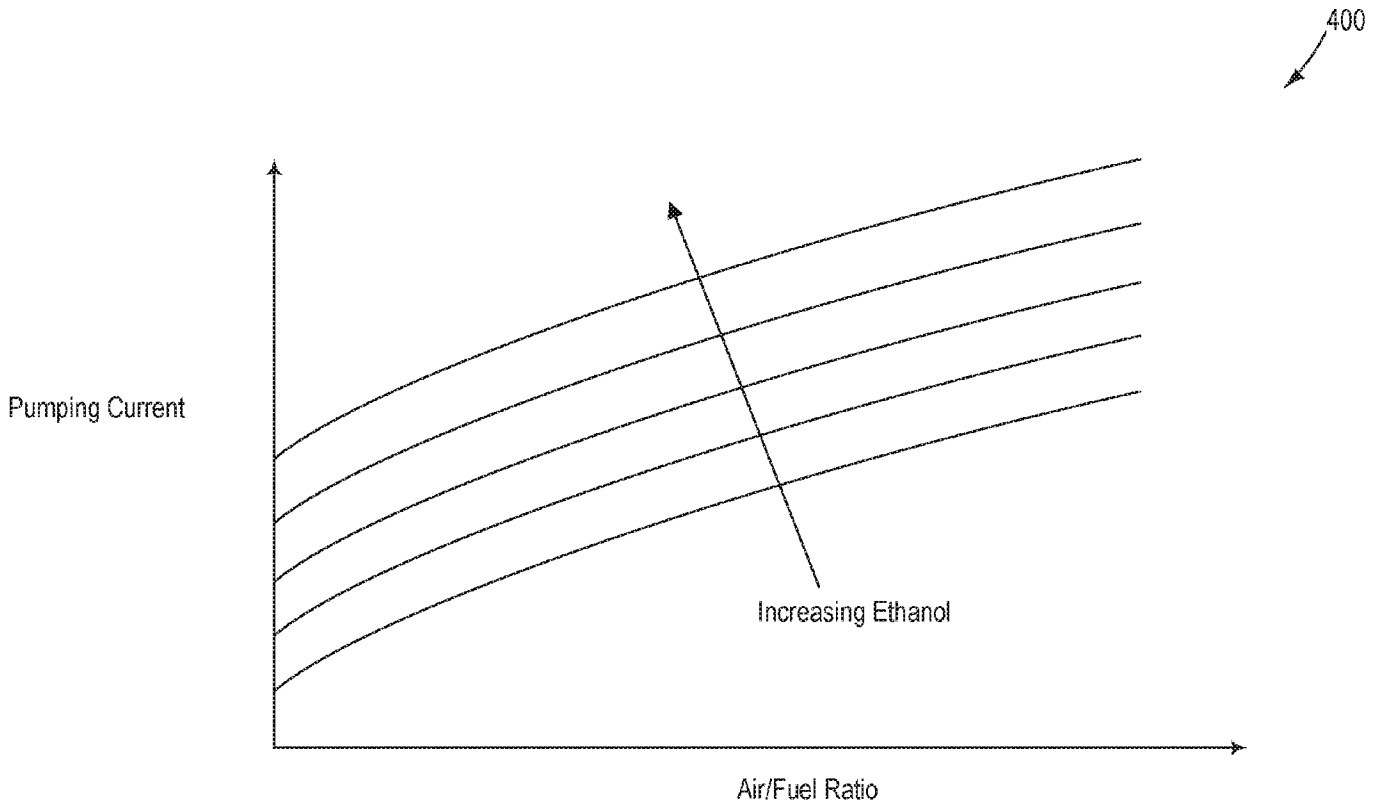
FIG. 4 shows a graph depicting the impact of fuel ethanol concentration on outputs of an exhaust oxygen sensor.

As an example, in FIG. 4, a graph 400 depicts how the ethanol concentration of the fuel may impact the pumping current output by the oxygen sensor (e.g., oxygen sensor 126) when the oxygen sensor operates at a reference voltage high enough to dissociate water vapor and carbon dioxide. For a given ethanol concentration, as seen in graph 400, the air/fuel ratio may increase for increases in the pumping current. Thus, for a given ethanol concentration a known relationship may be established between the pumping current and air/fuel ratio. Changes in ethanol content may result in changes in the pumping current even when the air/fuel ratio remains constant. Specifically, the pumping current may increase in response to increases in the ethanol concentration. However, without knowing the ethanol concentration of the fuel, the extent to which the pumping current is affected by the ethanol content of the fuel may be unknown. In FIG. 3, air/fuel ratio estimates could be corrected for based on changes in the reference voltage since the reference voltage applied to the oxygen sensor is known. However, since the ethanol concentration may not be known, the air/fuel ratio may not be corrected due to changes in the concentration of ethanol in fuel. Without being able to account for the effects of humidity and ethanol concentration on the pumping current, the accuracy of estimates of the air/fuel ratio may be reduced at oxygen sensor reference voltages high enough to dissociate water vapor and carbon dioxide Moving on to FIG. 5, a method 500 is shown for correcting air/fuel ratio estimates due to changes in the ambient humidity and/or ethanol concentration of fuel. Specifically, a pumping current output by an exhaust oxygen sensor (e.g. oxygen sensor 126) may be compared to a reference pumping current. The reference pumping current may be an expected pumping current based on a reference voltage applied to the oxygen sensor, and a known relationship between the pumping current and air/fuel ratio. In other words, the transfer functions introduced in FIG. 3 may be used for determining the reference pumping current. Thus, a known relationship between pumping current and air/fuel ratio at a given reference voltage of the oxygen sensor (e.g. transfer function), may be compared to a pumping current output by the oxygen sensor to give an offset. The offset may then be used to estimate the air/fuel ratio. Instructions for carrying out method 500 may be stored in a memory of an engine controller such as controller 12 shown in FIG. 1. Further, method 500 may be executed by the controller.

Method 500 begins at 502 by estimating and/or measuring engine operating conditions. Engine operating conditions may be based on feedback from a plurality of sensors and may include: engine temperature, engine speed and load, intake mass air flow, manifold pressure, etc.

Based on feedback from an exhaust oxygen sensor (e.g. oxygen sensor 126), the controller may measure a first pumping current (Ip) generated by a lower first reference voltage applied to the oxygen sensor. The lower first reference voltage may be a reference voltage low enough such that water vapor and carbon dioxide are not dissociated (e.g., 450 mV). As explained earlier with reference to FIG. 2, the first pumping current of the oxygen sensor at the first reference voltage may be relatively unaffected by changes in ambient humidity or ethanol concentration of the fuel because water vapor and carbon dioxide are not dissociated. Thus, the first pumping current may be directly related to an air/fuel ratio. As such, the controller may proceed to 506 and estimate the air/fuel ratio based on the pumping current measured at 504. As explained with reference to FIG. 2, the controller may estimate the air/fuel ratio based on a change in the pumping current from a reference point when fuel was not being injected to the engine such as during a deceleration fuel shut-off (DFSO) event.

Subsequently at 508, the controller may determine if the conditions are met for operating the exhaust oxygen sensor in a variable voltage (VVs) mode. Specifically, the oxygen sensor may be operated in a VVs mode when the controller determines that it is desired to estimate one or more of the exhaust gas properties. The oxygen sensor may be used in a VVs mode to estimate various exhaust gas properties such as the water content, humidity, ethanol concentration, etc. Changes in the pumping current output by the oxygen sensor due to modulation of the reference voltage between a first lower reference voltage and a higher second voltage may be used to estimate water content and other properties of the exhaust gas. As an example, if the engine is a dual-fuel engine, the controller may determine that it is desired to estimate the water content of the exhaust gas so that the amount of secondary fuel injected to the engine may be adjusted. If the controller determines that VVs operation of the oxygen sensor is not desired, then method 500 continues to 510 and the controller may continue to estimate the air/fuel ratio based on outputs from the oxygen sensor operating at the lower first reference voltage. Thus, at 510 the reference voltage of the oxygen sensor may be maintained at the lower first reference voltage where water vapor and carbon dioxide are not dissociated. The controller may then proceed to 520 and adjust engine operation based on the estimated air/fuel ratio. As an example, the controller may adjust the amount of fuel injected to the engine cylinders (e.g., cylinder 30) if the estimated air/fuel ratio is different from a desired air/fuel ratio, where the desired air/fuel ratio may be based on the engine operating parameters including: engine load, engine speed, engine temperature, etc.

However, if at 508 the controller determines that it is desired for the oxygen sensor to operate in VVs mode, method 500 may proceed to 512 and the controller may apply a higher second reference voltage to the oxygen sensor and determine a reference Ip at the second reference voltage. The second reference voltage may be a voltage high enough to dissociate water vapor and carbon dioxide (e.g., 1100 mV). As described with reference to FIG. 3, the reference Ip may be determined based on a transfer function relating the pumping current to the air/fuel ratio for a given applied reference voltage (e.g., for a given reference voltage greater than the base, first reference voltage of approximately 450 mv). Further, the transfer function may be limited to a baseline condition for the ambient humidity and ethanol concentration. In one example the baseline condition may be when the ethanol concentration and ambient humidity are both 0%. As will be explained later, in another example the baseline condition may be based on an updated transfer function where the ambient humidity and ethanol concentration may be different than 0%. Thus, the controller may look-up a transfer function associated with the second reference voltage applied to the sensor at 512 from a plurality of transfer functions where each transfer function is assigned to a particular reference voltage. In one example, the plurality of transfer functions may be stored in a memory of the controller as a function of oxygen sensor reference voltage. An example transfer function is depicted as plot 602 in graph 600 of FIG. 6. Plot 602 relates air/fuel ratios with reference pumping currents for a particular reference voltage. Plot 602 may be associated with an applied reference voltage of 1100 mV. As such, plot 602 may represent a known relationship between pumping current and air/fuel ratio for the second reference voltage applied to the oxygen sensor in method 500 when humidity and ethanol concentration are at a baseline condition. The controller may then use the transfer function associated with the second reference voltage to determine a reference pumping current.

In one embodiment, the controller may determine the reference pumping current based on the air/fuel ratio determined at 506 during non-VVs mode operation (e.g., during operating the oxygen sensor at the lower first reference voltage), and the transfer function associated with the second reference voltage. The air/fuel ratio determined at 506 represents the most recent air/fuel ratio estimate when the oxygen sensor was operating at its lower first voltage. Thus, the controller may look-up the pumping current defined by the transfer function associated with the second reference voltage at the air/fuel ratio determined at 506. As an example, the air/fuel ratio estimated at 506 may be air/fuel ratio $A_1$ depicted in graph 600. As seen in graph 600, the air/fuel ratio $A_1$ defines a point $X_1$ on plot 602. Point $X_1$ has an associated pumping current $P_1$. Thus, $P_1$ may be an example of the reference pumping current determined by the controller at 512. Since the reference voltage of the oxygen sensor may be adjusted from the lower first voltage to the higher second voltage over a very short time interval, the air/fuel ratio may be relatively the same during the transition between the two reference voltages. Point $X_1$ therefore may represent the reference pumping current that would be expected at the current air/fuel ratio in the exhaust gas, under baseline humidity and ethanol concentration conditions.

In another embodiment, the controller may determine the reference pumping current based on a pre-set air/fuel ratio and a transfer function associated with the second reference voltage. As an example, the pre-set air/fuel ratio may be 1, as depicted in graph 600. As seen in graph 600, the air/fuel ratio of 1 may define a point $X_2$ on plot 602. Point $X_2$ has an associated pumping current $P_2$. Thus, $P_2$ may be the reference pumping current determined by the controller at 512. The controller may therefore determine the reference pumping current by looking up pumping current defined by the transfer function associated with the second reference voltage at a pre-set air/fuel ratio. As an example, point $X_2$ in graph 600 may therefore represent a reference pumping current that would be expected for the applied second reference voltage for a pre-set air/fuel ratio.

Thus, the reference Ip may be determined based on the most recent air/fuel ratio estimate when the oxygen sensor was operating at its lower first voltage, and/or based on a pre-set air/fuel ratio.

Once the controller has determined the reference pumping current at 512, the controller may then proceed to measure the actual pumping current output by the oxygen sensor at the higher second reference voltage at 514. As an example, the measured pumping current at the higher second reference voltage may be at a level $P_3$ as depicted in graph 600 of FIG. 6. As depicted, $P_3$ may be greater than $P_1$ and $P_2$. In another examples, $P_3$ may be less than $P_2$, but greater than $P_1$. In another example, $P_3$ may be less than $P_1$ and $P_2$. The measured pumping current $P_3$ may be different than the reference pumping current due to changes in the ambient humidity and/or ethanol concentration of the fuel from the baseline condition. Then, at 516, the controller may determine an Ip offset based on the measured Ip at 514 and the reference Ip determined at 512.

In one embodiment, the Ip offset may be determined based on a difference between the reference Ip and the actual measured Ip at the higher second reference voltage. The reference Ip may be the reference Ip determined based on the most recent air/fuel ratio estimate when the oxygen sensor was operating at its lower first reference voltage. As an example, in graph 600 of FIG. 6, the difference, D, may be the difference between the reference pumping current $P_1$ and the actual measured pumping current $P_3$. As explained in the above embodiment, the air/fuel ratio may be assumed to remain constant at $A_1$ during the transition from the lower first to higher second reference voltage. Thus, point $X_3$ may define the measured pumping current $P_3$ at the same air/fuel ratio as the reference pumping current defined at point $X_1$. The difference D, may therefore represent a difference between the reference pumping current and the measured pumping current for the current air/fuel ratio. The Ip offset may therefore shift the transfer function for the associated reference voltage by the amount of difference between the reference Ip and the actual measured Ip. As an example, in FIG. 6, plot 602 may be shifted vertically upwards by the amount D. In other words, the controller may update the transfer function for an associated reference voltage based on the difference between the measured Ip and the reference Ip. As an example, the updated or shifted transfer function may be plot 604 in graph 600 of FIG. 6. The air/fuel ratio may therefore be determined by looking up the point on the updated transfer function defined by the measured pumping current.

It is important to note that under the current embodiment, the Ip offset may be updated continually or after a pre-set duration. The duration may be an amount of time, number of engine cycles, etc. As such, the reference Ip may change if the transfer function is shifted as a result of an update of the transfer function. However, if the transfer function is not updated and the measured pumping current changes, then those changes in pumping current may be associated with changes in the air/fuel ratio. Air/fuel ratios may therefore be determined by looking up the associated air/fuel ratio for the measured pumping current as defined by the most recently updated transfer function.

In another embodiment, the Ip offset may be established by comparing the measured Ip to a reference Ip defined by a transfer function associated with the higher second reference voltage of the oxygen sensor for a pre-set air/fuel ratio. Changes in the Ip away from the reference Ip may be associated with an air/fuel measurement. As an example, the pumping current $P_3$ as shown in graph 600 of FIG. 6 may be the measured pumping current at the higher second reference voltage. Just as in the previous embodiment, a difference may be established between the measured pumping and a pumping current established based on the transfer function for the second reference voltage and the most recent air/fuel ratio estimated when the oxygen sensor was operating at the lower first reference voltage. However, instead of shifting the transfer function, the measured pumping current may be superimposed on the transfer function for the higher second reference voltage under baseline humidity and ethanol concentration conditions. As an example, in FIG. 6, point $X_3$ may be shifted down to point $X_1$. The controller may then determine the Ip offset based on the difference between the reference pumping current and the shifted measured Ip. As an example, in graph 600 the difference E may be the Ip offset, which may be the difference in pumping current between the reference pumping current for the pre-set air/fuel ratio at $X_2$, and the shifted measured pumping current $P_1$ and point $X_1$ on the transfer function represented as plot 602. Changes in the Ip offset may then be associated with changes in the air/fuel ratio. It is important to note that in the current embodiment, the baseline transfer function is not modified and as such may represent conditions of 0% humidity and ethanol concentration of the fuel. Additionally the Ip offset may be updated continuously, or after a duration, where the duration may be pre-set based on an amount of time, number of engine cycles, etc. Thus, the air/fuel ratio may be estimated by determining the pumping current based on the Ip offset, and then looking up the air/fuel ratio defined on the transfer function defined by the offset pumping current.

After determining the Ip offset at 516, the controller may then estimate the air/fuel ratio at 518 based on the Ip offset and the reference Ip. As described above the Ip offset may be used to match the measured pumping current to a transfer function which may define a corresponding air/fuel ratio. In one example, the transfer function may be adjusted by the Ip offset, and the air/fuel ratio may be determined by the air/fuel ratio defined by the value for the adjusted transfer function associated with the measured Ip. In another example, the measured Ip is adjusted by the Ip offset and the air/fuel ratio may be determined by the air/fuel ratio defined by the value for a reference transfer function associated with the measured Ip.

After estimating the air/fuel ratio at the second higher reference voltage of the oxygen sensor at 518, the controller may continue to 520 and adjust engine operation based on the estimated air/fuel ratio. In one example, the controller may adjust the amount of fuel being injected to the engine cylinders (e.g., cylinder 30) based on a desired amount of fuel. The desired amount of fuel may be determined based on engine operating parameters such as engine load, engine speed, engine temperature, EGR flow, etc.

Method 500 may then proceed to 522 and the controller may continue to estimate the air/fuel ratio based on the determined Ip offset at 516. Thus, as long as the oxygen sensor continues to operate at the same higher second reference voltage, the same Ip offset determined at 516 may be used to estimate the air/fuel ratio. As such, subsequent changes in the pumping current may be indicative of changes in the air/fuel ratio. As an example, if the Ip offset adjusts the transfer function associated with the higher second reference voltage, then the measured pumping current may be looked up on the adjusted transfer function, and the associated air/fuel ratio may be used as the air/fuel ratio estimate. Thus, changes in pumping current occurring after the Ip offset has been established may be associated with changes in the air/fuel ratio, which can be estimated by looking up the air/fuel ratios corresponding to the measured pumping currents on the adjusted transfer function. In another example, if the Ip offset adjusts the pumping currents output by the oxygen sensor, and not the transfer function, then changes in the adjusted pumping currents may be looked up on the transfer function and the associated air/fuel ratios may be used to estimate the air/fuel ratio.

When the oxygen sensor is no longer operating at the higher second reference voltage, the Ip offset may no longer be needed, and the air/fuel ratio may be estimated normally by comparing the pumping current output by the oxygen sensor to the pumping current output when the oxygen sensor was operating during a non-fueling event. However, when the reference voltage is stepped up again to the higher second reference voltage, it is possible that the ambient humidity or ethanol concentration may have changed since the most recent operation at the higher second reference voltage. Thus, new Ip offsets may be determined whenever the reference voltage applied to the oxygen sensor is adjusted from the lower first voltage to the higher second voltage. In another example, new estimates of the Ip offset may be determined after a pre-set duration, where the duration may be a number of variable voltage cycles. Thus, the Ip offset may be determined after a pre-set number of cycles between operation at the first and second reference voltages. In another examples, the duration may be an amount of time, number of engine cycles, etc.

In this way, a method may include during operation of an exhaust oxygen sensor in a variable voltage mode where a reference voltage of the oxygen sensor is adjusted from a lower, first voltage to a higher, second voltage, adjusting engine operation based on an air-fuel ratio estimated based on an output of the exhaust oxygen sensor and a learned correction factor based on the second voltage. The output of the exhaust oxygen sensor is a pumping current output while the exhaust oxygen sensor is operating at the second voltage. The learned correction factor is further based on a previously estimated air-fuel ratio during operating the exhaust oxygen sensor in a non-variable voltage mode where the reference voltage is maintained at the first voltage. The method may further comprise determining the learned correction factor based on an initial pumping current output by the exhaust oxygen sensor at the second voltage, a pumping current to air-fuel ratio transfer function for the second voltage, and a reference pumping current determined from the pumping current to air-fuel ratio transfer function for the second voltage at the previously estimated air-fuel ratio. Determining the learned correction factor may further include: selecting the pumping current to air-fuel ratio transfer function from a plurality of pumping current to air-fuel ratio transfer functions based on a value of the second voltage; and adjusting the selected pumping current to air-fuel ratio transfer function based on a difference between the initial pumping current and the reference pumping current, where the input to the adjusted transfer function is the output of the exhaust oxygen sensor and the output is the air-fuel ratio. The method may further comprise adjusting the output of the exhaust oxygen sensor based on the learned correction factor and estimating the air-fuel ratio during operation at the second voltage based on the adjusted output and a pumping current to air-fuel ratio transfer function for the second voltage. The method may further comprise determining the learned correction factor based on a difference between an initial pumping current output by the exhaust oxygen sensor at the second voltage and a first reference pumping current based on a pre-set reference air-fuel ratio and a difference between the initial pumping current and a second reference pumping current determined from a pumping current to air-fuel ratio transfer function for the second voltage at a previously estimated air-fuel ratio during operating the exhaust oxygen sensor in a non-variable voltage mode where the reference voltage is maintained at the first voltage. The method may further comprise while operating the exhaust oxygen sensor in the variable voltage mode, determining an additional engine operating parameter of the engine based on a first output of the exhaust oxygen sensor at the lower, first voltage and a second output of the exhaust oxygen sensor at a higher, second voltage, wherein the additional engine operating parameter is one or more of an ambient humidity, a water content of exhaust gas, and a fuel ethanol content.

In this way a method may also comprise: operating an exhaust oxygen sensor in a variable voltage mode where a reference voltage of the oxygen sensor is increased from a lower, first voltage to a higher, second voltage to determine a first operating condition of an engine; and while operating at the second voltage, adjusting an output of the exhaust oxygen sensor based on a reference pumping current at the second voltage and estimating an air-fuel ratio based on the adjusted output. The output of the exhaust oxygen sensor is a measured pumping current. Adjusting the output of the exhaust oxygen sensor based on the reference pumping current includes comparing the reference pumping current to the measured pumping current and determining an offset based on a difference between the measured pumping current and the reference pumping current. The reference pumping current is based on a previous air-fuel ratio estimated when the exhaust oxygen sensor was operating in a non-variable voltage mode, before the operating the exhaust oxygen sensor in the variable voltage mode and a pumping current to air-fuel ratio transfer function for the second voltage. The reference pumping current is based on a pre-set air-fuel ratio a pumping current to air-fuel ratio transfer function for the second voltage. The method may further comprise determining an adjusted pumping current to air-fuel ratio transfer function by applying the determined offset to a known pumping current to air-fuel ratio transfer function for the second voltage and estimating the air-fuel ratio based on an output of the adjusted transfer function upon inputting the measured pumping current. The method may further comprise continuing to estimate the air-fuel ratio during operating the exhaust oxygen sensor at the second voltage based on changes in the measured pumping current from an initially measured pumping current, where the initially measured pumping current is a first pumping current output by the exhaust oxygen sensor when transitioning to operating in the variable voltage mode and at the second voltage. The first operating condition of the engine includes one or more of ambient humidity, water content of exhaust gas, a secondary fluid injection amount, and an ethanol content of the fuel.

In one embodiment, a system for an engine may comprise: an exhaust oxygen sensor disposed in an exhaust passage of the engine; and a controller with computer readable instructions for: during a first condition when the exhaust oxygen sensor is operating at a base reference voltage where water molecules are not dissociated, estimating a first exhaust air-fuel ratio based on a first output of the exhaust oxygen sensor and adjusting operation of the engine based on the first exhaust air-fuel ratio; and during a second condition when the exhaust oxygen sensor is operating at a second reference voltage, higher than the base reference voltage, where water molecules are dissociated, estimating a second exhaust air-fuel ratio based on a measured pumping current output by the exhaust oxygen sensor and a learned correction factor, the learned correction factor based on the second reference voltage and a reference pumping current. The system of claim 17, wherein the learned correction factor is based on a difference between an initially measured pumping current when transitioning from the first condition to the second condition and the reference pumping current. The reference pumping current is one of a reference pumping current based on the first air-fuel ratio and a pumping current to air-fuel ratio transfer function for the second voltage or a reference pumping current based on a pre-set, reference air-fuel ratio and the pumping current to air-fuel ratio transfer function for the second voltage. The pre-set, reference air-fuel ratio is approximately one.

Turning to FIG. 7, a graph 700 depicts how an air/fuel ratio as estimated using an exhaust oxygen sensor (e.g., oxygen sensor 126 shown in FIG. 1) may change under various engine operating conditions. Plot 702 shows changes in the reference voltage applied to the oxygen sensor, plot 704 shows changes in the ethanol concentration in the fuel, and plot 706 shows changes in the amount of fuel injected to the engine cylinders (e.g., cylinder 30). Plot 708 shows changes in the pumping current output by the oxygen sensor, and plot 710 shows changes in the estimated air/fuel ratio of the exhaust gas. As explained above, the reference voltage may be a voltage applied to the oxygen sensor via an engine controller (e.g. controller 12). Changes in the fuel ethanol concentration may occur when a different ethanol blend fuel is used to re-fuel the engine. The fuel injection amount may also be controlled by the controller depending on demands of the engine (engine load, engine speed, engine temperature, EGR flow, etc.). The estimated air/fuel ratio is the air/fuel ratio estimated by the controller. Estimates of the air/fuel ratio may be based on the pumping current output by the oxygen sensor and transfer functions relating pumping currents to air/fuel ratios for specific voltages.

Starting before time $t_1$ the reference voltage of the oxygen sensor is at a lower first reference voltage $V_1$. $V_1$ may be a low enough reference voltage such that water vapor and carbon dioxide are not dissociated (e.g., 450 mV). In addition, the fuel injection amount and ethanol concentration of the fuel are at respective lower first levels $F_1$ and $E_1$. As such, the pumping current output by the oxygen sensor is at a lower first level $C_1$ and the estimated air/fuel ratio is at a higher first level $A_2$. At $t_1$ the reference voltage increases from the lower first level $V_1$ to a higher second level $V_2$. $V_2$ may be a voltage high enough to dissociate water vapor and/or carbon dioxide (e.g. 1100 mV). As explained with reference to FIG. 3, increases in the reference voltage applied to the oxygen sensor may result in increases in the pumping current output by the oxygen sensor. As such, the measured pumping current increases at $t_1$ from the lower first level $C_1$, to a higher second level $C_3$. Fuel ethanol concentration and fuel injection amount remain at their respective lower first levels $E_1$ and $F_1$ at $t_1$. Despite the increase in pumping current at $t_1$, the estimated air/fuel ratio may remain the same at the higher first level $A_2$. Due to the increase in the reference voltage applied to the oxygen sensor, the controller may select a transfer function associated with the higher second reference voltage $V_2$. Thus, the transfer function may be used to account for the increase in pumping current as a result of the increase in reference voltage at $t_1$.

At $t_2$, the amount of fuel injected to the engine cylinders increases from the lower first level $F_1$ to a higher second level $F_2$. The reference voltage remains the same at the higher second voltage $V_2$ and likewise the fuel ethanol concentration stays at $E_1$. Due to the increase in fuel injection amount at $t_2$, the pumping current output by the oxygen sensor may decrease from the higher second level $C_3$ to an intermediate third level $C_2$. $C_2$ may be greater than $C_1$ but less than $C_3$. As explained earlier, the pumping current may be directly related to an oxygen concentration of the exhaust gas. Increases in fuel injection amount may result in decreases in the oxygen concentration of the exhaust gas which may be reflected in a decrease in the pumping current. At time $t_2$ the controller may continue to use the transfer function associated with the reference voltage $V_2$, and thus may register the decrease in pumping current output by the oxygen sensor as a decrease in the air/fuel ratio. Thus at $t_2$ the estimated air/fuel ratio may decrease from the higher first level, $A_2$, to a lower second level, $A_1$.

At $t_3$ the reference voltage may return to the lower first level $V_1$ from the higher second level $V_2$. Concurrently, the fuel injection amount may decrease from the higher second level $F_2$ to the lower first level $F_1$. Due to the decrease in reference voltage back to $V_1$, the pumping current may decrease from the intermediate third level $C_2$ to the lower first level $C_1$. At $t_3$ the controller may switch back to using a transfer function associated with the lower first reference voltage $V_1$ instead of the higher second voltage $V_2$. As such, the estimated air/fuel ratio may increase from the lower second level $A_1$ back to the higher first level $A_2$. At time $t_4$, the fuel ethanol concentration may increase from the lower first level $E_1$ to a higher second level $E_2$. However, since the reference voltage remains at $V_1$ where water vapor and carbon dioxide are not dissociated, the increase in ethanol concentration does not affect the pumping current output by the oxygen sensor. Thus, the measured pumping current remains at the lower first level $C_1$ at $t_4$. As such, the estimates air/fuel ratio stays at the higher first level $A_2$. The fuel injection amount remains at the lower first level $F_1$.

At $t_5$ the fuel injection amount stays at the lower first level $F_1$ and the fuel ethanol concentration remains at the higher second level $E_2$. However, the reference voltage of the oxygen sensor increases from the $V_1$ to $V_2$. Due to the increase in reference voltage, the pumping current may increase at $t_5$. However the pumping current may increase from the lower first level $C_1$ to a maximum fourth level $C_4$ where $C_4$ may be greater than $C_3$. This may be due to the increase of the ethanol concentration of the fuel. As described with reference to FIG. 4, increases in the fuel ethanol concentration may result in increases in the pumping current when the oxygen sensor is operating at a reference voltage high enough to dissociate water vapor and carbon dioxide. Because at $t_5$ the oxygen sensor is operating at the higher second reference voltage $V_2$, the ethanol concentration of the fuel does affect the output of the oxygen sensor. Due to the increase in ethanol concentration from $E_1$ to $E_2$ therefore, the measured pumping current increases to from $C_1$ to $C_4$ at $t_5$. Thus, the increase in pumping current at $t_5$ is greater than the increase at $t_1$ due to the increase in fuel ethanol concentration from $E_1$ to $E_2$. At $t_5$ the controller may use the transfer function associated with the higher second voltage $V_2$ to estimate the air/fuel ratio. However, without correcting for the increase in ethanol concentration from $E_1$ to $E_2$ the air/fuel ratio estimated by the controller may be greater than the first higher level $A_2$. To correct for the increase ethanol concentration, the controller may determine an Ip offset at $t_5$ as discussed in greater detail in FIG. 5. By comparing the measured pumping current output by the oxygen sensor to a reference pumping current, the controller may determine an Ip offset. The Ip offset may then be used to adjust estimates of the air/fuel ratio. In one example, this may include shifting the transfer function associated with $V_2$. In another example, the Ip offset may be used to adjust the pumping current measurements such that they are fitted to the transfer function associated with $V_2$.

The pumping current output by the oxygen sensor may be affected by changes in the amount of fuel injected to the engine cylinders, ethanol concentration of the fuel, and changes in the reference voltage applied to the oxygen sensor. Specifically, increases in the reference voltage may cause increases in the pumping current. Increases in the fuel injection amount, however, may cause decreases in the pumping current. The pumping current may only be affected by the concentration of ethanol in the fuel when operating at a voltage high enough to dissociate water vapor and carbon dioxide. When operating at a voltage high enough to dissociate water vapor and carbon dioxide, the pumping current output by the oxygen sensor may increase in response to increases in the ethanol concentration of the fuel. However, the actual air/fuel ratio in the exhaust gas may only be affected by the amount of fuel injected to the engine cylinders. Specifically, increases in the fuel injection amount may result in decreases in the air/fuel ratio. Thus, changes in fuel ethanol concentration and reference voltage of the oxygen sensor may not actually affect the air/fuel ratio. Therefore, estimates of the air/fuel ratio based on the pumping current output by the oxygen sensor may be corrupted when the reference voltage of the oxygen sensor or the fuel ethanol concentration changes. Thus, to account for changes in the pumping current that do not correspond to actual changes in the air/fuel ratio, the controller implement several learned correction factors to increase the accuracy of estimates of the air/fuel ratio. To account for changes in the pumping current due to changes in the reference voltage, the controller may select a transfer function associated with the reference voltage the oxygen sensor is currently operating at. If the pumping current changes due to changes in the fuel ethanol concentration when the oxygen sensor is operating at a voltage high enough to dissociate water vapor and/or carbon dioxide, the controller may learn an Ip offset. The Ip offset may be used to either adjust subsequent outputs of the oxygen sensor, or to adjust the transfer function used to estimate the air/fuel ratio at the current operating reference voltage.

In this way, the systems and method described herein may increase the accuracy of estimations of the air/fuel ratio during operation of an exhaust gas oxygen sensor in a variable voltage mode where the sensor is adjusted between a lower first voltage and a second higher voltage. Specifically, the accuracy of the air/fuel ratio may be increased when the oxygen sensor is operating at a reference voltage high enough to dissociate water vapor and/or carbon dioxide. The oxygen sensor may adjusted between a lower first reference voltage at which water vapor and carbon dioxide are not dissociated and a higher second voltage at which water vapor and optionally carbon dioxide are dissociated. When operating at the higher second voltage, outputs of the oxygen sensor in the form of a pumping current (Ip) may become corrupt due to contributions to the oxygen concentration from dissociated water vapor and/or carbon dioxide. The air/fuel ratio may be estimated by comparing the pumping current of the oxygen sensor to an output of the oxygen sensor during a non-fueling event such as during deceleration fuel shut-off (DFSO). Thus, the accuracy of the air/fuel estimates may be affected by the accuracy of the oxygen sensor. As such, air/fuel ratio estimates may be reduced when the oxygen sensor operates at its higher second reference voltage. A first offset may be learned to account for changes in the pumping current of the oxygen sensor when operating at the second reference voltage. However, contributions from the water vapor and/or carbon dioxide to the output of the oxygen sensor may change depending on the ambient humidity and ethanol concentration of a fuel. As such, the accuracy of estimates of the air/fuel ratio may be reduced the ambient humidity and/or ethanol concentration of the fuel change.

However, a second offset may be learned to account for changes in the pumping current of the oxygen sensor due to changes in the ambient humidity and ethanol concentration of the fuel. Thus, a technical effect of increasing the accuracy of air/fuel ratio estimates is achieved during operation of an exhaust oxygen sensor in a variable voltage mode by comparing a reference pumping current of the oxygen sensor to a measured pumping current and determining an offset based on change in the pumping current from the reference pumping current. Specifically, the reference pumping current may be determined based on a most recent air/fuel ratio estimate when the oxygen sensor was not operating in a variable voltage mode and was instead operating at a voltage low enough such that water vapor and/or carbon dioxide were not dissociated. Alternatively, the reference pumping current may be determined based on a pre-set pumping current. The reference pumping current may then be compared to a pumping current measured when the oxygen sensor is operating at a voltage high enough to dissociate water vapor and/or carbon dioxide. An Ip offset may be learned based on the change in the measured pumping current from the reference pumping current. The Ip offset may then be used to estimate an air/fuel ratio. In one example, the Ip offset may adjust a known transfer function that relates pumping currents to air/fuel ratios for the higher second reference voltage of the oxygen sensor. The air/fuel ratio may then be estimated based on the air/fuel ratio associated with the point on the adjusted transfer function defined by the measured pumping current. In another example, the Ip offset may adjust the measured pumping current to a point on a known transfer function relating pumping currents to air/fuel ratios under baseline humidity and ethanol fuel conditions. The baseline humidity and ethanol fuel conditions may be defined when both are 0%.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during a first condition, adjusting engine operation based on first air-fuel ratio estimated based on a first output of an exhaust oxygen sensor operating at lower, first voltage; and during a second condition, in response to a request to determine an exhaust gas property of exhaust gas, operating the exhaust oxygen sensor at a higher, second voltage to obtain a second output and adjusting engine operation based on a second air-fuel ratio estimated based on the second output and a stored pumping current to air-fuel ratio transfer function.

2. The method of claim 1, wherein the stored pumping current to air-fuel ratio transfer function is selected from a plurality of stored pumping current to air-fuel ratio transfer functions based on a value of the second voltage.

3. The method of claim 1, wherein the input to the stored pumping current to air-fuel ratio transfer function is the second output of the exhaust oxygen sensor, and wherein the output of the stored pumping current to air-fuel ratio transfer function is the second air-fuel ratio.

4. The method of claim 1, wherein the exhaust gas property of the exhaust gas includes one or more of water content, humidity, and ethanol concentration.

5. The method of claim 1, further comprising, during a third condition, while operating the exhaust oxygen sensor at the second voltage to obtain a third output, adjusting the stored pumping current to air-fuel ratio transfer function based on an offset between the third output and a reference output of the exhaust oxygen sensor, the reference output determined based on the stored pumping current to air-fuel ratio transfer function and a third air-fuel ratio.

6. The method of claim 5, wherein the third air-fuel ratio is estimated based on an output of the exhaust oxygen sensor obtained while operating the exhaust oxygen sensor at the first voltage, prior to adjusting the reference voltage to the second voltage.

7. The method of claim 5, wherein the third air-fuel ratio is a pre-set, reference air-fuel ratio of approximately one.

8. The method of claim 5, further comprising, during the third condition, adjusting engine operation based on a fourth air-fuel ratio estimated based on the third output and the adjusted stored pumping current to air-furl ratio transfer function.

9. A method, comprising:

after adjusting a reference voltage of an exhaust oxygen sensor from a lower, first voltage to a higher, second voltage, in response to there being an offset between an actual output of the exhaust oxygen sensor while operating at the second voltage and an expected output of the exhaust oxygen sensor, updating a stored transfer function relating exhaust oxygen sensor outputs to air-fuel ratios based on the offset, the expected output determined based on the stored transfer function and a first air-fuel ratio; and during subsequent operation of the exhaust oxygen sensor at the second voltage, obtaining a second output of the exhaust oxygen sensor and adjusting engine operating based on a second air-fuel ratio estimated based on the updated stored transfer function and the second output.

10. The method of claim 9, wherein the first air-fuel ratio is estimated based on an output of the exhaust oxygen sensor prior to adjusting the reference voltage to the second voltage.

11. The method of claim 9, wherein the first air-fuel ratio is a pre-set, reference air-fuel ratio.

12. The method of claim 11, wherein the pre-set reference air-fuel ratio is approximately one.

13. The method of claim 9, wherein the stored transfer function is selected from a plurality of stored transfer functions based on a value of the second voltage.

14. The method of claim 9, wherein the stored transfer function is a pumping current to air-fuel ratio transfer function, wherein the input to the updated stored transfer function is the second output of the exhaust oxygen sensor, and wherein the output of the updated stored transfer function is the second air-fuel ratio.

15. The method of claim 9, further comprising adjusting the reference voltage of the exhaust oxygen sensor from the lower, first voltage to the higher, second voltage in response to a request to determine an exhaust gas property of exhaust gas, the exhaust gas property including one or more of water content, humidity, and ethanol concentration.

16. The method of claim 9, further comprising, during operating the exhaust oxygen sensor at the first voltage, adjusting engine operation based on a third air-fuel ratio estimated based on a third output of the exhaust oxygen sensor.

17. The method of claim 9, wherein the output of the exhaust oxygen sensor is a pumping current output.

18. The method of claim 9, further comprising while subsequently operating the exhaust oxygen sensor at the second voltage, determining an additional engine operating parameter based on the second output of the exhaust oxygen sensor and a third output of the exhaust oxygen sensor obtained while operating the exhaust oxygen sensor at the lower, first voltage and, wherein the additional engine operating parameter is one or more of an ambient humidity, a water content of exhaust gas, and a fuel ethanol content.

19. A system for an engine, comprising:

an exhaust oxygen sensor disposed in an exhaust passage of the engine; and a controller with computer readable instructions programmed to:

estimate a first air-fuel ratio based on a first output of the exhaust oxygen sensor operating at a lower, first reference voltage;

increase a reference voltage of the exhaust oxygen sensor to a higher, second reference voltage and obtaining a second output of the exhaust oxygen sensor;

determine an offset between the second output and a reference output of the exhaust oxygen sensor determined based on a stored transfer function relating exhaust oxygen sensor outputs to air-fuel ratios for the second voltage, using the first air-fuel ratio as an input to the stored transfer function;

update the stored transfer function based on the determined offset; and adjust engine operation based on a second air-fuel ratio estimated based on a subsequent output of the exhaust oxygen sensor operating at the second voltage and the updated stored transfer function.

20. The system of claim 19, wherein the computer readable instructions further include instructions for selecting the stored transfer function from a plurality of stored transfer functions stored in memory of the controller based on a value of the second voltage.

* * * * *